United States Patent [19]

Dees, Jr. et al.

[11] Patent Number: 4,816,319

[45] Date of Patent: Mar. 28, 1989

[54] DECORATIVE SURFACE COVERINGS

[75] Inventors: Martin Dees, Jr., Landisville; William C. Dorsey, Conestoga; Arlene J. G. Stewart, Lancaster, all of Pa.

[73] Assignee: Armstrong World Industries, Inc., Lancaster, Pa.

[21] Appl. No.: 127,037

[22] Filed: Nov. 27, 1987

Related U.S. Application Data

[63] Continuation-in-part of Ser. No. 59,518, Jun. 8, 1987, abandoned.

[51] Int. Cl.[4] ..... B05D 5/06

[52] U.S. Cl. ..... 428/167; 428/168; 428/172; 428/173

[58] Field of Search ..... 428/156–173

[56] References Cited

U.S. PATENT DOCUMENTS

| | | | |
|---|---|---|---|
| 1,873,098 | 8/1932 | Young | 428/167 |
| 1,989,704 | 2/1935 | Lequillon | 428/167 X |
| 2,057,873 | 10/1936 | Atwood | 428/167 X |
| 2,366,209 | 1/1945 | Morris | 428/167 |
| 2,587,594 | 3/1952 | Chavannes et al. | 428/167 X |
| 3,305,381 | 2/1967 | van Wagenen | 428/167 X |
| 3,804,657 | 4/1974 | Eyman et al. | 428/172 X |
| 3,810,813 | 5/1974 | Ellis | 428/172 |
| 3,931,429 | 1/1976 | Austin | 428/172 X |
| 3,958,043 | 5/1976 | McKee, Jr. et al. | 428/172 X |
| 4,068,030 | 1/1978 | Whitman | 428/172 X |
| 4,126,727 | 11/1978 | Kaminski | 428/172 |
| 4,214,028 | 7/1980 | Shortway et al. | 428/172 X |
| 4,320,163 | 3/1982 | Schwartz | 428/172 X |
| 4,440,826 | 4/1984 | Whitman | 428/908.8 X |

*Primary Examiner*—Nancy A. B. Swisher

[57] ABSTRACT

A surface covering product is disclosed which comprises a substrate material, an impervious coating upon said material with a decorative design as part of the impervious coating, and, raised transparent or slightly translucent elements printed upon said coating. The raised elements are formed as convex-shaped lens elements and comprise a thixotropic plastic containing particles of solid material.

6 Claims, 1 Drawing Sheet

DECORATIVE SURFACE COVERINGS

CROSS-REFERENCE TO RELATED APPLICATION

The present application is a continuation-in-part of co-pending application Ser. No. 59,518, filed June 8, 1987, now abandoned.

BACKGROUND OF THE INVENTION

The present invention relates to a surface covering product. In particular, the present invention relates to a surface covering product comprising a substrate; a first impervious decorated layer substantially covering said substrate; and, a second layer partially covering said first layer, said second layer comprising discrete portions of a thixotropic plastic material.

In the prior art, it is known to provide surface covering products having disposed thereon raised elements which contain particles of solid material. For example, U.S. Pat. No. 4,348,447 to Miller and Petzold shows non-skid plastic flooring structures in which inorganic particles are embedded in a cured plastic matrix in a substantially abutting relationship. Since the adhesive can be printed in a selective pattern, the raised elements give the appearance of an embossed-in register flooring material. Because such particles are applied to the adheeive surface of the matrix, however, particles applied in this manner typically do not penetrate uniformly throughout the plastic matrix. In addition, the number of particles is substantially limited and the particles must be covered over with a thin coating of clear plastic material to fully bond them to the material. In coating the particles with such a thin film, the underlying coating, interstitial to the raised elements, is coated also.

In each of these references, however, the raised elements, while they may have some decorative value, would have interfered with and obscured any underlying decoration, if such decoration were present. Further, such raised elements while useful for increasing wear resistance and slip resistance, create additional difficulties in the maintenance of the surfaces, and additional care must be taken in the maintenance of flooring employing such devices.

SUMMARY OF THE PRESENT INVENTION

It is an object of the present invention to provide a surface covering product having raised elements which enhance the decorative effect of the product.

It is a further object of the present invention to provide a surface covering product having elements of enhanced decorative effect in a product without the maintenance difficulties typically associated with raised elements.

According to one embodiment of the present invention, there is provided a decorative surface covering product comprising: (a) a substrate; (b) a first impervious wear layer of a synthetic plastic polymeric material, said layer substantially covering one surface of said substrate; (c) a decorative material as part of the impervious layer; and (d) a second layer partially covering said first wear layer, said second layer comprising discrete portione of a thixotropic plastic material having a plurality of convex-shaped elements extending upwardly therefrom.

DETAILED DESCRIPTION OF THE INVENTION

U.S. Patent Application Ser. No. 8,732, having a common assignee, shows a surface covering product comprising a substrate material, an impervious coating upon said substrate material, and raised elements selectively disposed upon said coating, which raised elements comprise a thixotropic plastic containing particles of solid material. The teachings of this earlier application are hereby incorporated by reference as if set forth fully herein.

The raised elements disclosed in the abovecited application, however, are intended to increase the wear and slip resistance of surface covering product. Other than providing a textured surface, it was not initially perceived that such raised elements could serve a significant decorative function.

It has now, surprisingly been found that such raised elements can serve as a design enhancement, creating unique visual effects. In particular, where the raised elements are transparent or slightly translucent, their presence provides a lenti-cular effect, varying the effect of an underlying design and providing a unique combination of visual and aesthetic product design effects.

Figure 1:
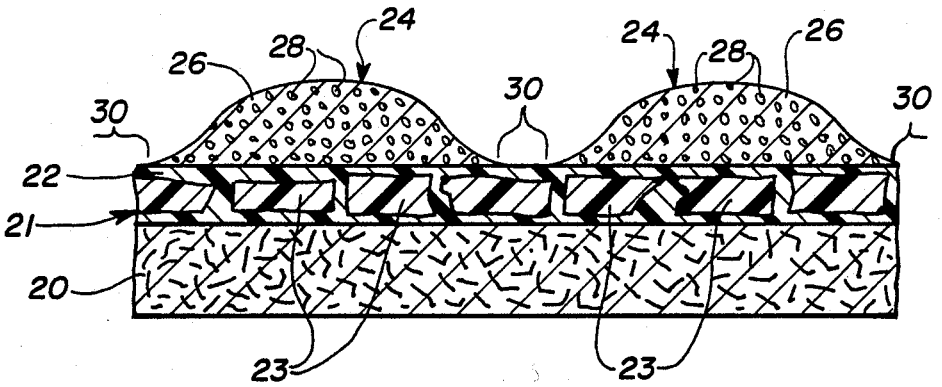
FIG. 1 shows a cross-sectional view of an embodiment of the present invention.

FIG. 1 shows an example in which this visual effect is particularly striking. FIG. 1 shows a surface covering product comprising a substrate 20 which is covered with an impervious coating 21 itself comprised of large chips 23 in a transparent or slightly translucent matrix 22. The chips form the decorative material to be viewed in the finished product. Selectively positioned upon the coating 21 are raised elements 24 of a transparent or slightly translucent thixotropic plastic material 26 which may contain particles of solid material 28. While no wear layer is necessary, portions of the underlying coating 21, represented as 30, may be left uncoated in the final product and, therefore, the coating 21 must be of wear layer quality.

Without the raised elements 24, the construction of FIG. 1 closely resembles known commercial products which show a layer of large chips in visual appearance. With the raised elements 24, which provide a lenticular effect to soften the hard edges of the chips and vary their apparent surface, the product has a three-dimensional visual appearance akin to a tessera tile floor.

The lenticular effect normally is secured wit a transparent material in the raised elements. A slightly translucent material may be used in the raised elements, but the translucent material must permit one to view the decorative material therebelow to the extent to create a three-dimensional effect thereof in the finished product. Also the solid material 28 must be transparent or slightly translucent and small in size so that it will not cause the loss of the lenticular effect. It has been noted that a slightly translucent effect is preferable wherein particles in the raised elements cause a diffusion of the light within the raised elements which result in the preferred visual effect.

Figure 2:
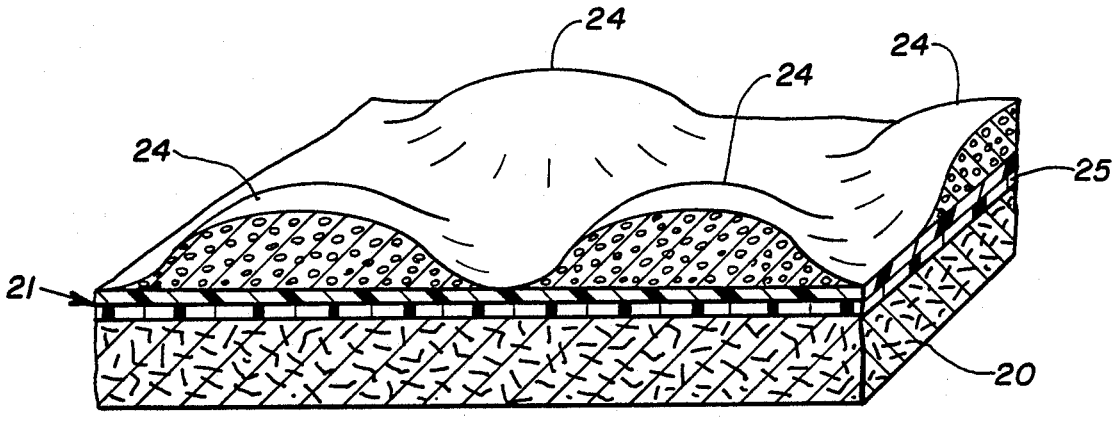
FIG. 2 shows a perspective view of another embodiment of the present invention.

In FIG. 2 there is shown another example of the invention herein. The coating 21 with the chips 23 above described have been replaced with a printed design 25. The design is covered with the impervious coating 21, but it could be within the coating 21 as the chips of FIG. 1 are positioned. The rest of the structure of the product of FIG. 2 is the same as in FIG. 1. If the design printed is similar to the face of a carpet the lenticular effect of the raised elements 24 will create the three-dimensional appearance of a carpet while having the wearability of a vinyl flooring.

THE SUBSTRATE

The present invention is not believed to be dependent on the substrate employed. Rather, it is believed that any of the substrates normally employed in the surface covering field can be employed in the practice of the present invention.

The substrate or backing sheet should be composed of strong, durable and flexible material. The backing can be woven, felted or a solid sheet of synthetic or natural flexible material. The conventional flexible flooring backing is a web of felted fibers. The felt generally is produced using a Fourdrinier or cylinder paper machine with the thickness of the resulting sheet being that usually used in floor and wall covering, that is, from 0.02 to 0.08 inch. A thickness of about 0.082 inch is usually preferred. The fibrous material used is normally cellulosic, although other fibers can be used including those of mineral and animal origin. The sources of cellulosic material can include cotton or other rag material, wood pulp including both ground wood and chemical wood pulp, paper, boxes, or mixtures thereof in any proportion. The web can also contain fillers, such as wood flour.

The felt can be strengthened and improved in water resistance by impregnation with a bituminous material. Numerous bituminous materials are well-known as impregnants in the production of printed surface coverings and include asphalts of petroleum or tars and pitch or residues of animal vegetable origin. These materials can be treated to attain the desired physical properties of softening point or viscosity for satisfactory use by such treatment as air blowing, steam distillation, and the like.

The impregnant should be uniformly dispersed throughout the felt sheet. This can be controlled to some extent by the saturating technique through use of pressure rolls in the saturating bath. Where the impregnant is not uniformly dispersed throughout, blistering can frequently occur due to high concentrations of material adjacent to one surface of the felt.

If an impregnated backing sheet is used, it usually is provided with one or more seal coats, such as lacquer, prior to printing the decorative design. The seal coats perform the desirable function of masking the color of the felt and preventing the impregnant from bleeding through and staining the wear layer and, in addition, create a smooth uniform surface suitable as a base for printing. Felt sheets of the type commonly used as backings for printed surface coverings tend to have minor surface irregularities due to non-uniformities in the felt-making equipment. The sheet also frequently shows a number of small protruding lengths of fibers. The seal coats are designed to hide all these irregularities. The total thickness of seal coats required is normally from about 1 to about 12 mils. This thickness can be created through use of a single thick coating or several superimposed thinner coatings. Using the conventional techniques of coating, such as flexible doctor roller application, the desired thickness is created by use of more than one coating. The use of multiple coatings is also desirable in promoting optimum adhesion of the wear surface layer to the backing, since the seal coat applied directly to the fibrous backing can be designed for optimum sealing against migration of bituminous impregnant and the uppermost seal coat can be designed for optimum adhesion to the polyvinyl chloride surface wear layer.

Certainly, it is not envisioned that the present invention will be limited in anyway by the choice of substrate. In fact, although a substrate of some kind is normally required to provide necessary mechanical strength in processing, surface coverings are well known in which a strippable, release carrier is employed. Such a release carrier can then be removed from the surface covering product subsequent to the final fusion procedure. Such a strippable substrate is within the scope of the present invention.

Choices among available substrates, therefore, should be made on some basis such as manufacturing convenience or physical properties of the end product.

THE COATING

Once a substrate is chosen, it should be coated with a suitable impervious material. While it would be possible to apply the plastic as raised elements directly to a wet-laid felt, unless a plastic wear layer is applied to protect the interstitial felt, the product would have limited commercial value. At the very least, a decorative coating would normally be applied, even if the final product is to be wear layered for protection.

Of course, a glass mat substrate must be prepared with an impervious coating, usually a plastisol which may or may not be foamable, to impregnate the mat and seal the glass fibers.

As noted previously, the coating which must be employed may be as simple as a sealant for a wet-laid felt or as complex as a multi-layered, multi-element construction. The practice of the present invention is not intended to be bound by the particular coating employed. Many coatings and coating methodologies are known to the art which would have application to the present invention, including but by no means limited to foamable and non-foamable plastisols, resinous dry blends, stencil lay-ups and the like.

The coating should, however, be impervious so that the thixotropic material deposited thereon remains on the surface to form a discrete element.

THE RAISED ELEMENTS

Over the impervious coating discrete elements are created by depositing beads of a pseudoplastic thixotropic liquid which may contain solid particles. Such deposition can be carried out using various methods known to the art, however, screen printing, though normally employed to deposit inks on more porous surfaces, has been employed with good success.

The elements may be in any shape or pattern, however, geometrics such as repeated patterns of raised circles, squares, diamonds, and the like have been demonstrated to be effective visually. The elements will have a convex upper configuration to form a lens structure.

The discrete elements may be from about three one-thousandths of an inch (0.003") to about eight onehundredths of an inch (0.08") above the underlying construction, preferably from about fifteen one-thousandths of an inch (0.015") to about forty-five one-thousandths of an inch (0.045"), and most preferably, about three one-hundredths of an inch (0.03"). Further, such raised elements if they are to form an effective lenticular surface, should cover from about thirty percent (30%) to over ninety percent (90%) of the total surface area in the final product in order to provide an effective three-dimensional visual, with the exact percentage a function of the decorative material and the visual effect desired.

THE THIXOTROPIC MATERIAL

The present invention is made possible through the combination of an impervious coated substrate and the rheological characteristics of the plastic material applied. With an application methodology such as a rotary screen, a pseudoplastic thixotropic material can be deposited on the impervious coated substrate, typically in thicknesses exceeding that of normal printing inks. Because of the properties of the material, lateral flow can be controlled or substantially eliminated.

A thixotropic material is a material which exhibits dual rheological behavior, that is, they impart high viscosity to systems under low shear and low viscosity under high shear.

Fumed and precipitated silicas are probably the most often used thixotropic agents, or thixotropes, although various inorganic and organic materials are known to be operative, including such inorganic material as very fine particle, organophilic clays and such organic materials as high substituted sorbatols or calcium/organic complexes. Fumed silicate, available commercially from the Degussa Company, under the trade designation Aerosil 200, has been employed to advantage.

The quantity of such material added to the resin paste system will determine the thixotropic nature of the resulting system, and its viscosities under various rates of shear. Such properties will determine the lateral flow of the plastisol deposited as raised elements on the substrate.

Various resinous materials may be employed as the thixotropic material in the present invention and these include virtually any useful resinous plastisols, while polyvinyl chloride resins have been employed with advantage.

To be useful in the practice of the present invention, sufficient thixotropic material must be present to enable the resin system to remain plastic under shear, losing its pseudoplastic characteristics rapidly when the shear force is removed.

THE PARTICLES

Although the thixotropic material can by itself provide the discrete elements of the surface covering product, abrasion properties of such surface covering will typically be greatly improved by the addition of solid particles. Such particles may be an inorganic material such as silica quartz or the like. These particles may be clear or slightly translucent.

In order to be useful as an abrasion resistive material in the present invention, the particles should be of suitable dimension to pass through a No. 10 U S. Standard seive series mesh, a screen (U.S. Standard) with openings of about two millimeters (2.0 mm) and yet be retained on a No. 200 mesh screen (U.S. Standard), with openings of about seventy microns (70 u.m.). Preferred results, however, have been obtained with particles which would pass through a No. 25 mesh screen (U.S. Standard) with openings of about six hundred microns (600 u.m.) and be retained on a No. 50 mesh screen (U.S. Standard), with openings of about two hundred fifty microns (250 u.m.). The particles of solid material are of a MOHS hardness of 7 to 9, and preferably about 7.

EXAMPLE 1

A twenty-inch (20") square portion of saturated flooring felt available commercially from Armstrong World Industries under the trade designation HC-217 was prepared for use as a substrate. First, the felt was smear coated with a water-based lacquer and dried in a hot air oven at 250° F. for two minutes to seal the face surface of the felt. The material prepared in this manner was then employed as a carrier for the deposition of a twenty-five one thousandths inch (0.025") layer of solid polyvinyl chloride chips as a single layer of chips.

A 5 to 6 mil layer of clear polyvinyl plastisol of the following composition:

| | | Weight Percent |
|---|---|---|
| Primary Plasticizer | Dioctyl Phtalate | 13.2 |
| Stabilizer | Synpron 1522 | 1.3 |
| Stabilizer/Plasticizer | Epoxidized Soya Oil | 1.8 |
| Plasticizer | Texanol Isobutyrate TXIB | 16.6 |
| PVC Resin | Tenneco 1732 | 16.5 |
| PVC Resin | Geon 121 | 34.1 |
| PVC Resin | Goodyear M-7O | 16.5 |

was applied to the chip base with a reverse roll coater, then gelled in a hot air oven at about 270° F. for about two minutes. This clear polyvinyl plastisol layer fills in the area between the chips and covers the top of the chips to form, with the chips, the impervious layer.

Using a rotary screen printer equipped with a screen approximately two one-hundredths of an inch (0.02") in thickness, a 25 to 30 mil slurry was selectively deposited in a pattern of circular dots on the surface of the gelled material. The slurry was a suspension of clear particles in liquid composed of small diameter quartz and polyvinyl chloride particles of less than 600 microns in diameter in liquid plastisol. The particles were a MOHS hardness of 7. The slurry employed had the following formulation:

| | | Weight Percent |
|---|---|---|
| Primary Plasticizer | Dioctyl Puthalate | 11.0 |
| Stabilizer | Synpron 1522 | 1.3 |
| Stabilizer/Plasticizer | Epoxidized Soya Oil | 1.1 |
| Plasticizer | Texanol Isobutyrate TXIB | 13.4 |
| Maleic Acid Ester | Perenol E-2 | 1.6 |
| Surfactant | Surfynol 104A | 1.15 |
| PVC Resin | Tenneco 1732 | 13.4 |
| PVC Resin | Geon 121 | 27.9 |
| PVC Resin | Goodyear M-70 | 13.4 |
| Fumed Silica | Aerosil 200 | 1.0 |
| Pigmented PVC Resin | Geon 103 FPF76 | 0.25 |
| Filler | Quartz | 14.5 |

The viscosity of the slurry with particles set forth above must be between 120 to 160 poise for the desired results. Viscosity is measured with a Brookfield Visiometer using a No. 6 spindle at 20 revolutions per minute. Viscosity is adjusted by varying the amount of plasticizer (TXIB).

The slurry-coated sheet was then fused with radiant heat at about 390° to 400° F. for approximately 1.5 to 2 minutes. The resulting surface covering product had a unique visual appearance in which the lenticular effect of the selectively-positioned raised convex dots softened the visual image of the underlyng chips.

EXAMPLE 2

Example 1 can be modified to replace the layer of chips with a printed design. The lacquer coating on the felt will be provided thereon with a printed design representative of a chip. A 5 to 6 mil layer of clear polyvinyl, as used in Example 1, is placed over the printed design to protect the design and form the impervious layer. This layer is gelled in a hot air oven at about 270° F. for about two minutes.

The slurry is prepared and applied as per the teachings of Example 1. Gelling and fusing is carried out as taught in Example 1 and the Example 2 product will have a unique visual appearance provided by the lenticular effect on the decorative layer. The printed design, will provide a three-dimensional visual effect, and the floor product is characterized by unique aesthetic features and enhanced appearance not heretofore achieved in floor products of vinyl-type construction.

What is claimed is:

1. A decorative surface covering product comprising:
(a) a substrate;
(b) a first impervious layer of a synthetic plastic polymeric material, said layer substantially covering one surface of said substrate;
(c) said impervious layer containing a decorative means adapted to provide a design effect; and
(d) a second layer partially covering said first layer, said second layer comprising discrete portions of a substantially transparent cured thixotropic plastic material having convex-shaped lens-like elements extending upwardly therefrom which enhance the decorative means of the first layer, said elements being in a repetitive pattern and covering substantially 90 percent of the first layer to form a three dimensional effect thereof.

2. The decorative surface covering product of claim 1 wherein the first impervious layer is comprised, in substantial part, of resin particles.

3. The decorative surface covering product of claim 1 wherein the first impervious layer is comprised, in substantial part, of a matrix of resin chips.

4. The decorative surface covering product of claim 1 wherein the first impervious layer is printed with decorative elements.

5. The decorative surface covering product of claim 1 wherein the second layer comprises raised discrete convex-shaped portions which are positioned on the first impervious layer and said raised portions are preferably 0.015 to 0.045 inches in height at the center of the convex shape.

6. The decorative surface covering product of claim 5 wherein the raised discrete portions contain solid particles of a MOHS hardness of at least 7 and a diameter size of 600 microns or less.

* * * * *